US009393831B1

(12) United States Patent
Schmidt

(10) Patent No.: US 9,393,831 B1
(45) Date of Patent: Jul. 19, 2016

(54) COVER GUARD FOR A RIM OF A PAINT CAN WITH AN ATTACHED PAINTBRUSH WELL

(71) Applicant: 360 Products, LLC, Wyckoff, NJ (US)

(72) Inventor: Kevin Schmidt, Wyckoff, NJ (US)

(73) Assignee: 360 Products, LLC, Wyckoff, NJ (US)

( * ) Notice: Subject to any disclaimer, the term of this patent is extended or adjusted under 35 U.S.C. 154(b) by 0 days.

(21) Appl. No.: 14/599,698

(22) Filed: Jan. 19, 2015

(51) Int. Cl.
*B44D 3/12* (2006.01)
*B65D 25/20* (2006.01)
*B65D 90/00* (2006.01)

(52) U.S. Cl.
CPC ..... *B44D 3/123* (2013.01); *B44D 3/128* (2013.01)

(58) Field of Classification Search
CPC ..... B44D 3/123; B44D 3/128; B65D 25/20
USPC ..... 220/697, 695, 699, 700
See application file for complete search history.

(56) References Cited

U.S. PATENT DOCUMENTS 2,591,482 A * 4/1952 Weltlich ..... 220/700
4,009,802 A * 3/1977 Hayduchok ..... B44D 3/128 220/697
4,203,537 A * 5/1980 McAlister ..... B65D 25/20 220/675
6,446,829 B1 * 9/2002 Malvasio et al. ..... 220/697

* cited by examiner

*Primary Examiner* — Fenn Mathew
*Assistant Examiner* — Andrew T Kirsch
(74) *Attorney, Agent, or Firm* — Richard M. Goldberg

(57) ABSTRACT

A cover guard for a rim of a paint can, includes a cover for covering a rim of a paint can to prevent entry of paint into the rim, the cover being at least part annular to surround an opening, and having an inverted U-shaped cross-section for receiving the rim therein, a brush wiper plate connected with the cover and extending within the opening, against which a paintbrush can be wiped for removing excess paint from the paintbrush which has been dipped into paint in the paint can, such that any excess paint falls back into the paint can, and a wet paintbrush cup connected to the cover for holding a web paintbrush therein.

12 Claims, 11 Drawing Sheets

COVER GUARD FOR A RIM OF A PAINT CAN WITH AN ATTACHED PAINTBRUSH WELL

BACKGROUND OF THE INVENTION

The present invention relates generally to paint cans, and more particularly, to a cover guard for a rim of a paint can with an attached paintbrush well.

Over two million one gallon paint cans are sold everyday in the United States. Conventional paint cans include a cylindrical side wall that is open at the upper end and closed by a circular bottom wall. The open upper end forms a rim with an annular recessed channel that is used for securing the circular lid on the paint can in closing relation to the open upper end.

After the lid is removed, in order to perform a painting operation, a user inserts or dips the bristles of a paintbrush into the paint held in the paint can. In order to remove excess paint from the bristles, the bristles are then scraped or wiped along the inner edge of the rim, so that the excess paint falls back into the can. The user then paints a surface with the paintbrush. These steps of dipping, wiping and painting continue repetitively.

However, a problem with such operation is that, during the wiping step to remove excess paint from the bristles, some of the excess paint falls into the annular recessed channel of the rim. In addition, when the paintbrush is not in use, there is no place to rest the paintbrush. Accordingly, the paintbrush is commonly laid across the open rim of the paint can. In such position, additional paint from the bristles of the paintbrush drips into the annular recessed channel.

Because of such operation, there results a buildup of paint in the annular recessed channel of the rim. This is disadvantageous since the paint buildup therein can make it difficult to insert the lid on the rim in a sealing relationship. Therefore, a user will commonly wipe the annular recessed channel with the bristles in an attempt to remove the excess paint from the annular recessed channel of the rim. Unfortunately, a majority of the paint remains in the annular recessed channel.

Because of the paint in the annular recessed channel, it can be difficult to reseat the lid in the annular recessed channel in a sealing manner. Further, when inserting the lid in the rim to close the paint can, some of the paint may be pushed out of the annular recessed channel and spill over the rim to the side of the paint can, or even worse, may splatter outwardly. Also, when the lid is reseated in the rim, it makes it difficult to remove the lid at a later time after the paint in the annular recessed channel has dried and adhered to the lid.

SUMMARY OF THE INVENTION

Accordingly, it is an object of the present invention to provide a cover guard for a rim of a paint can that overcomes the aforementioned problems.

It is another object of the present invention to provide a cover guard for a rim of a paint can that prevents any paint from entering the annular recessed channel of the rim, even during wiping of the paintbrush along the inner edge of the rim.

It is still another object of the present invention to provide a cover guard for a rim of a paint can that provides a separate wiping surface for the bristles of a paintbrush during a painting operation.

It is yet another object of the present invention to provide a cover guard for a rim of a paint can that includes a spill platform with an outer spill bead to prevent excess paint from dripping over the side of the cover guard.

It is a further object of the present invention to provide a cover guard for a rim of a paint can that includes an attached paintbrush well for holding a wet paintbrush.

It is a still further object of the present invention to provide a cover guard for a rim of a paint can that is easy and economical to use and manufacture.

In accordance with an aspect of the present invention, a cover guard for a rim of a paint can includes a cover guard for a rim of a paint can, includes a cover for covering a rim of a paint can to prevent entry of paint into the rim, the cover being at least part annular and having an inverted U-shaped cross-section for receiving the rim therein, and a wet paintbrush cup connected to the cover for holding a wet paintbrush therein.

The cover includes an outer wall being at least part annular, an inwardly spaced wall being at least part annular and concentric with the outer wall, and an upper wall which connects together the outer wall and the inwardly spaced wall so as to form a channel between the upper wall, the inwardly spaced wall and the upper wall and which is at least part annular, for receiving the rim of the paint can therein.

A surface of at least the outer wall and/or the inwardly spaced wall which faces the channel, includes a recess which is at least part arcuate for receiving a bead at an upper edge of the rim of the paint can, so as to hold the cover guard onto the rim. The recess is formed at an upper end of the outer wall and/or the inwardly spaced wall which faces the channel, immediately below the upper wall. Preferably, the recess is formed in each of the outer wall and the inwardly spaced wall which faces the channel.

There is further a bead on an outer periphery of the upper wall to prevent paint on the upper wall from escaping to a side of the paint can.

A finger tab is connected with the outer wall for aiding in removal of the cover from the rim of the paint can.

The wet paintbrush cup tapers down in dimensions toward a lower end thereof. The wet paintbrush cup includes an upper wall having an opening, and a downwardly extending wall structure extending down from the upper wall in surrounding relation to the opening and which is closed by a bottom wall.

There is also a bead on a periphery of the upper wall of the cover and the upper wall of the wet paintbrush cup to prevent paint on the upper wall from spilling over to a side of the paint can.

There is also at least one stop for stacking a plurality of cover guards with each other in a nesting arrangement, wherein at least one of the following operates as the stop at least one inclined wall of the downwardly extending wall structure, and at least one stop on an outer surface of the downwardly extending wall structure.

In accordance with another aspect of the present invention, a cover guard for a rim of a paint can, includes a cover for covering a rim of a paint can to prevent entry of paint into the rim, the cover being at least part annular to surround an opening, and having an inverted U-shaped cross-section for receiving the rim therein, and a brush wiper plate connected with the cover and extending within the opening, against which a paintbrush can be wiped for removing excess paint from the paintbrush which has been dipped into paint in the paint can, such that any excess paint falls back into the paint can.

The brush wiper plate is sector shaped and has a linear free edge against which the paintbrush can be wiped. Further, brush wiper plate is inclined downwardly toward the linear free edge.

There is also a drip guard wall extending upwardly from the cover at an angular position thereon corresponding to the wiper plate, to prevent excess paint on bristles of the paintbrush from spilling onto the cover. The drip guard wall extends arcuately around the cover, and also varies in height in an arcuate manner.

In accordance with still another aspect of the present invention, a cover guard for a rim of a paint can, includes a cover for covering a rim of a paint can to prevent entry of paint into the rim, the cover being at least part annular to surround an opening, and having an inverted U-shaped cross-section for receiving the rim therein, a brush wiper plate connected with the cover and extending within the opening, against which a paintbrush can be wiped for removing excess paint from the paintbrush which has been dipped into paint in the paint can, such that any excess paint falls back into the paint can, and a wet paintbrush cup connected to the cover for holding a wet paintbrush therein.

The above and other features of the invention will become readily apparent from the following detailed description thereof which is to be read in connection with the accompanying drawings.

DETAILED DESCRIPTION

Figure 1:
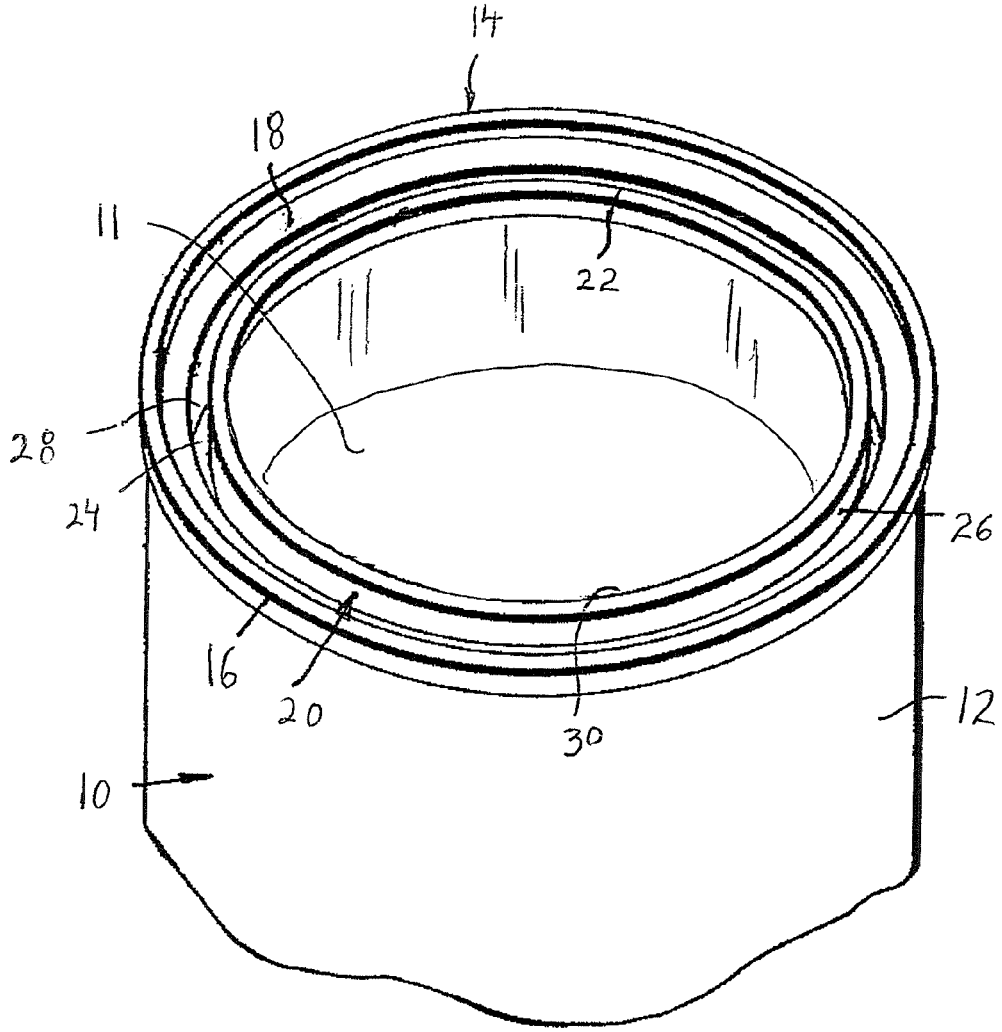
FIG. 1 is a perspective view of a conventional paint can.
Figure 2:
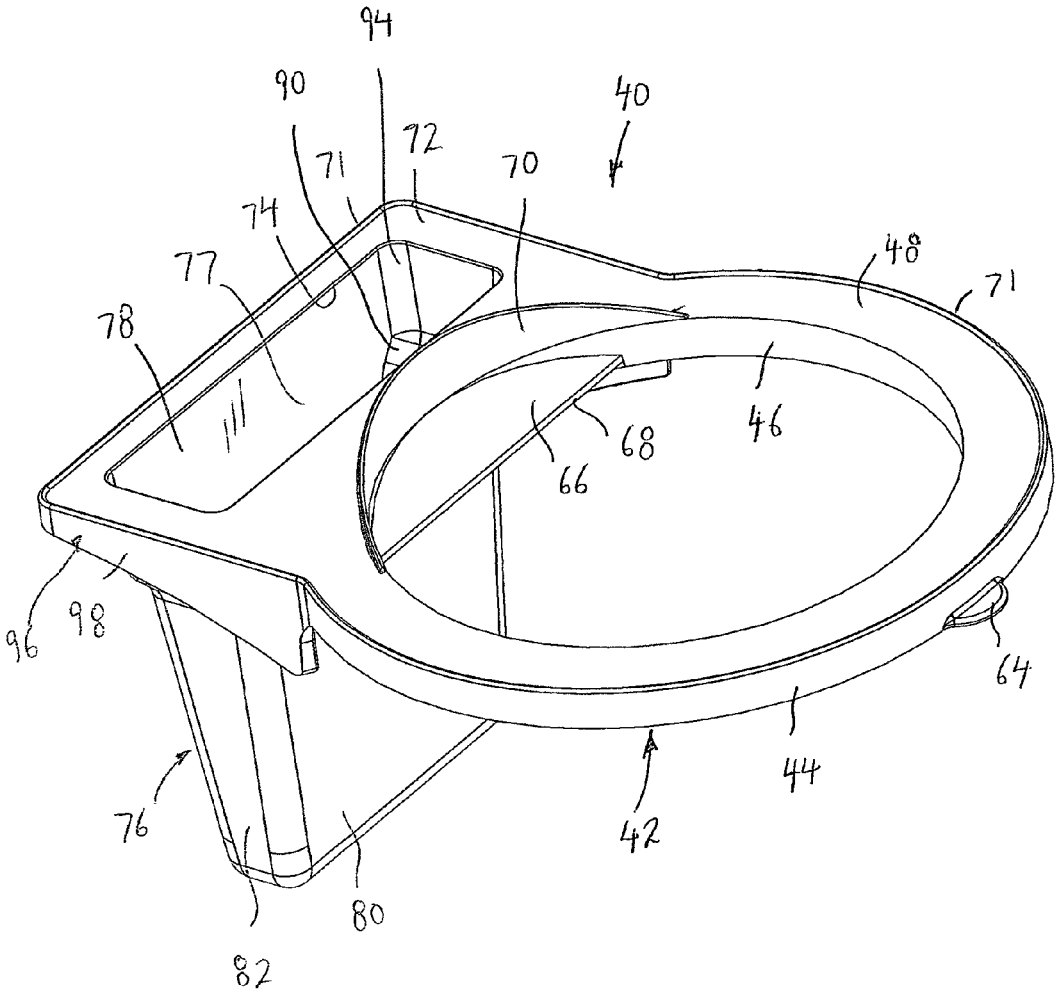
FIG. 2 is a top perspective view of a cover guard for a rim of a paint can according to the present invention.
Figure 10:
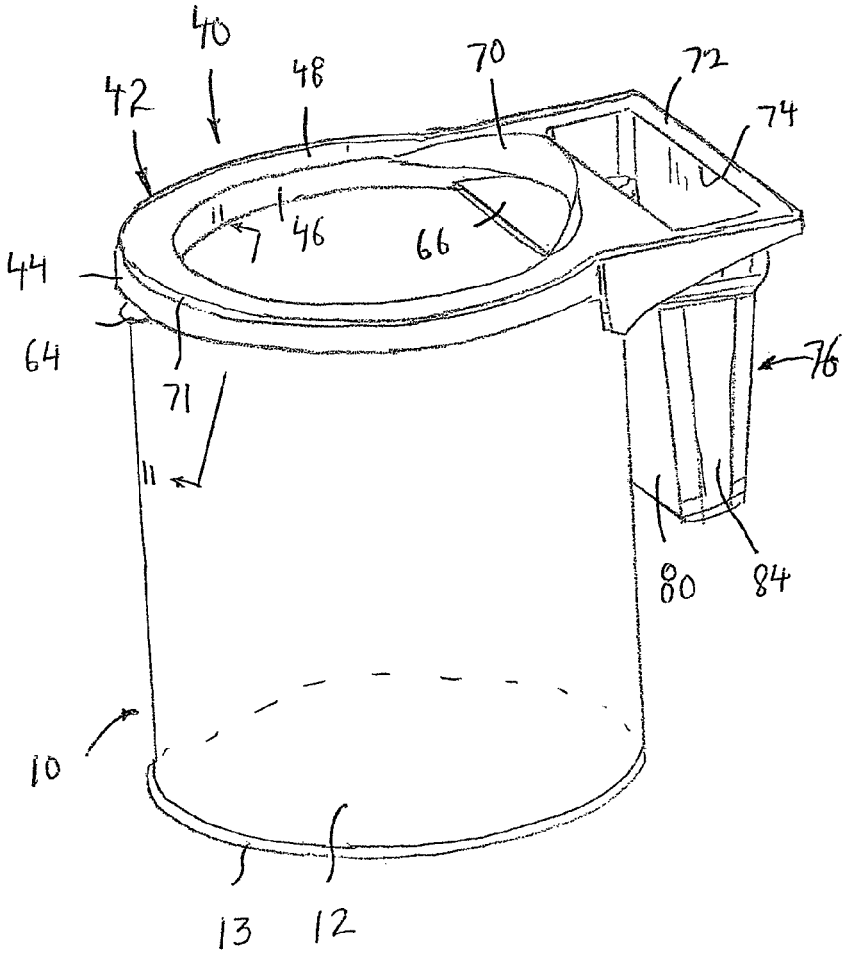
FIG. 10 is a perspective view showing the cover guard mounted on a paint can.
Figure 11:
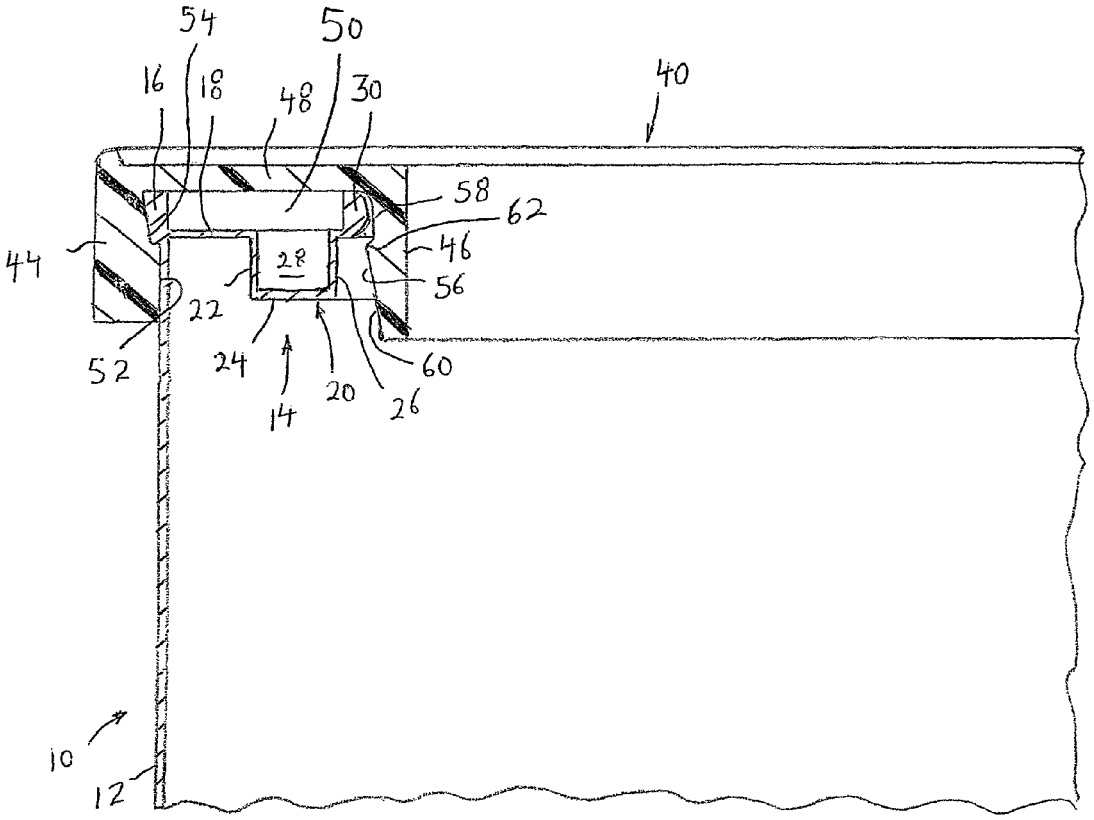
FIG. 11 is a cross-sectional view of FIG. 10, taken along line 11-11 thereof.

Referring first to FIGS. 1, 10 and 11, there is shown a conventional paint can 10 for holding paint 11, which includes a cylindrical wall 12, the lower of end of which is closed by a bottom wall 13, and the upper end or rim 14 which is open and forms a bead 16 at the upper end. Bead 16 forms a protrusion that extends laterally outwardly from the upper end 14 of cylindrical wall 12. An annular ledge 18 extends inwardly from cylindrical wall 12 at a position slightly below or at the lower end of bead 16 at the upper edge of open upper end 14. An annular U-shaped member 20 extends inwardly from the inner edge of annular ledge 18, and includes a first annular side wall 22 extending downwardly from the inner edge of annular ledge 18, an annular bottom wall 24 extending inwardly from the lower edge of first annular side wall 22 and a second annular side wall 26 extending upwardly from the inner edge of annular bottom wall 24, thereby defining an annular groove or channel 28 between annular walls 22, 24 and 26. Further, the upper free end of second annular side wall 26 is rolled or beaded, as indicated 30, to form a protrusion extending laterally inwardly, that is, away from annular groove 28.

A conventional cover or lid (not shown) for paint can 10 is provided with an annular depending flange (not shown) which is adapted to frictionally seat in a sealing manner in annular groove 28 between side walls 22 and 26, thereby closing the open end 14 of paint can 10.

Referring now to FIGS. 2-11, a cover guard 40 according to the present invention, for rim 14 of paint can 10, includes an annular cover 42 having an inverted U-shaped cross-section. Specifically, annular cover 42 includes an outer annular wall 44 and a parallel, spaced apart, inner annular wall 46 which are connected by an upper annular wall 48. Accordingly, an annular channel 50 is formed between annular walls 44, 46 and 48 for receiving rim 14 of paint can 10 therein. As shown best in FIG. 11, the inner facing surface 52 of outer annular wall 44 preferably includes an arcuate recess 54 at the upper end thereof for receiving bead 16 that extends laterally outwardly from the upper end 14 of cylindrical wall 12. Arcuate recess 54 preferably extends around an arc greater than 180 degrees, and more preferably, about 250 degrees. In like manner, the outer facing surface 56 of inner annular wall 46 preferably includes an arcuate recess 58 at the upper end thereof for receiving upper rolled free end 30 at the upper free end of second annular side wall 26. Arcuate recess 58 preferably extends around an arc greater than 180 degrees, and more preferably, about 250 degrees. In order to provide for a snap fit of annular cover 42 onto rim 14, inner annular wall 46 increases in thickness from the lower free edge thereof toward arcuate recess 58 so that outer facing surface 56 forms a sloped surface section 60 that aids in receiving rim 14 into annular recesses 54 and 58 in a snap fitting manner due to the flexible and resilient nature of the material of cover guard 40. Sloped surface section 60 terminates at its upper end, just below annular recess 58, so as to form an annular can rim retention bead 62. As shown in FIG. 11, in such condition, upper annular wall 48 is in covering relation to channel 28 of rim 14 to prevent entry of any paint therein.

It will be appreciated, however, that only one arcuate recess 54 or 58 is required to provide the snap fitting relation. Further, although the present invention has been described with respect to the different parts being annular, in fact, the parts may be part annular, extending around an arcuate angle that is not entirely annular. Reference hereinafter in the specification and claims to a part being annular is intended to encompass part annular structures as well.

In order to enhance the structural integrity of annular cover 42, the rear end of outer annular wall 44 preferably extends down along a skirt wall section 45 along an arcuate angle of about 100 degrees and has reinforcing support ribs 47 along the inner surface thereof.

In order to provide for easy removal of annular cover 42 from rim 14, a finger tab 64 extends outwardly from the outer surface of outer annular wall 44 at the front of cover guard 40 and which can be grasped to pull annular cover 42 from rim 14.

Figure 3:
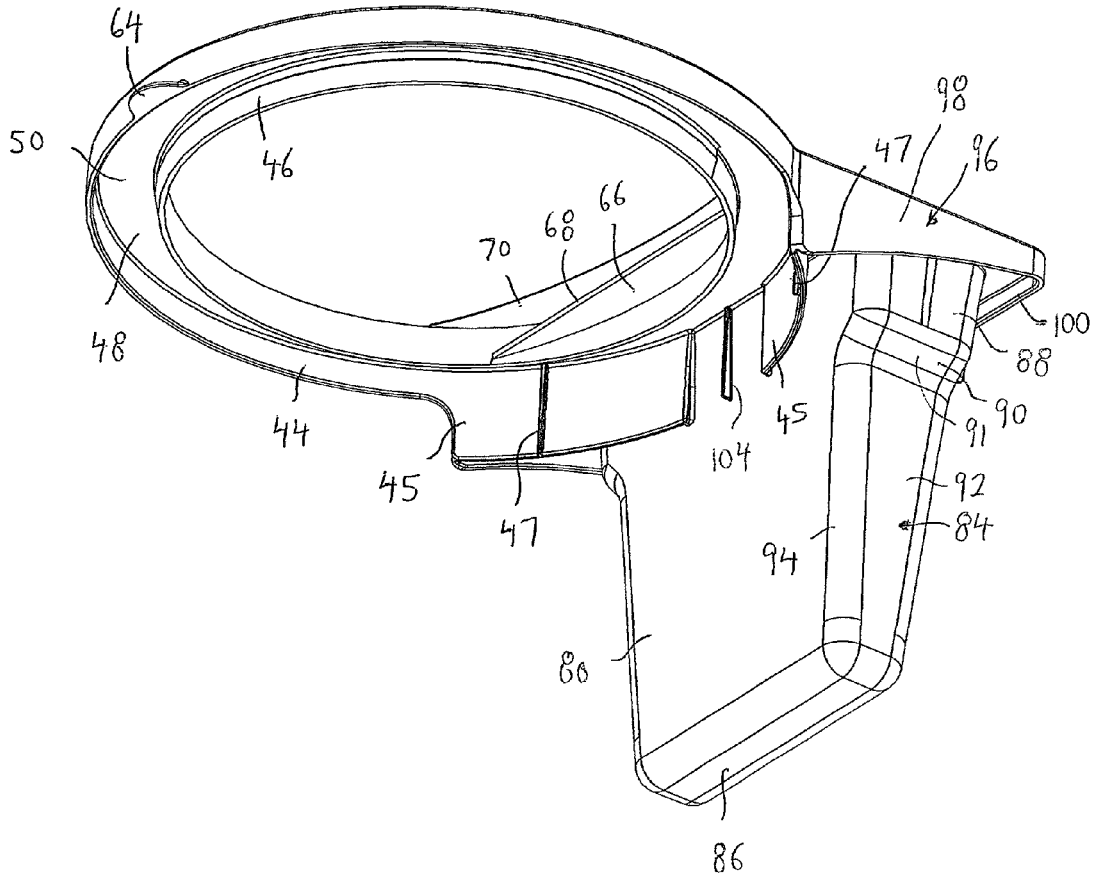
FIG. 3 is a bottom perspective view of the cover guard.
Figure 4:
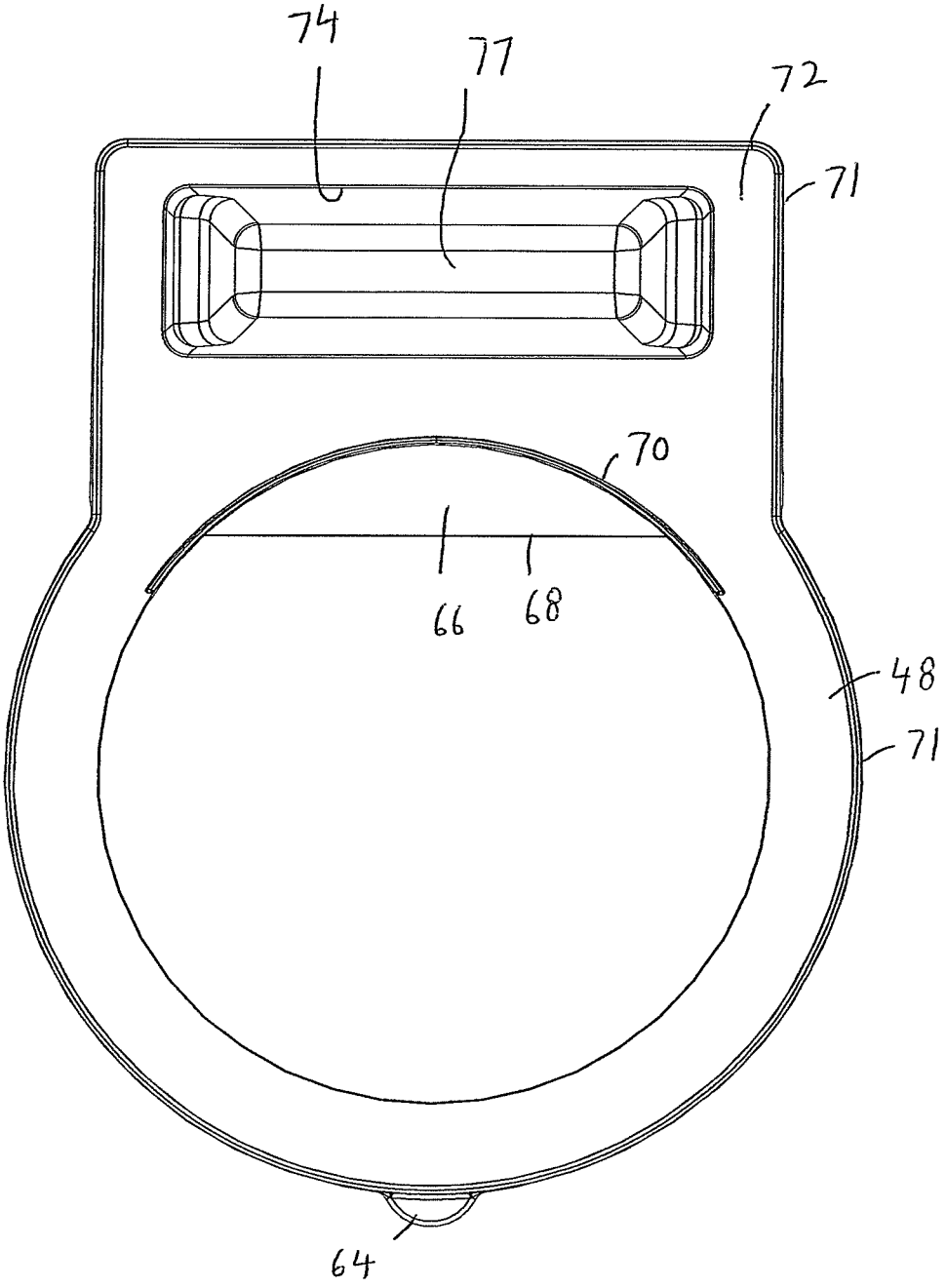
FIG. 4 is a top plan view of the cover guard.
Figure 5:
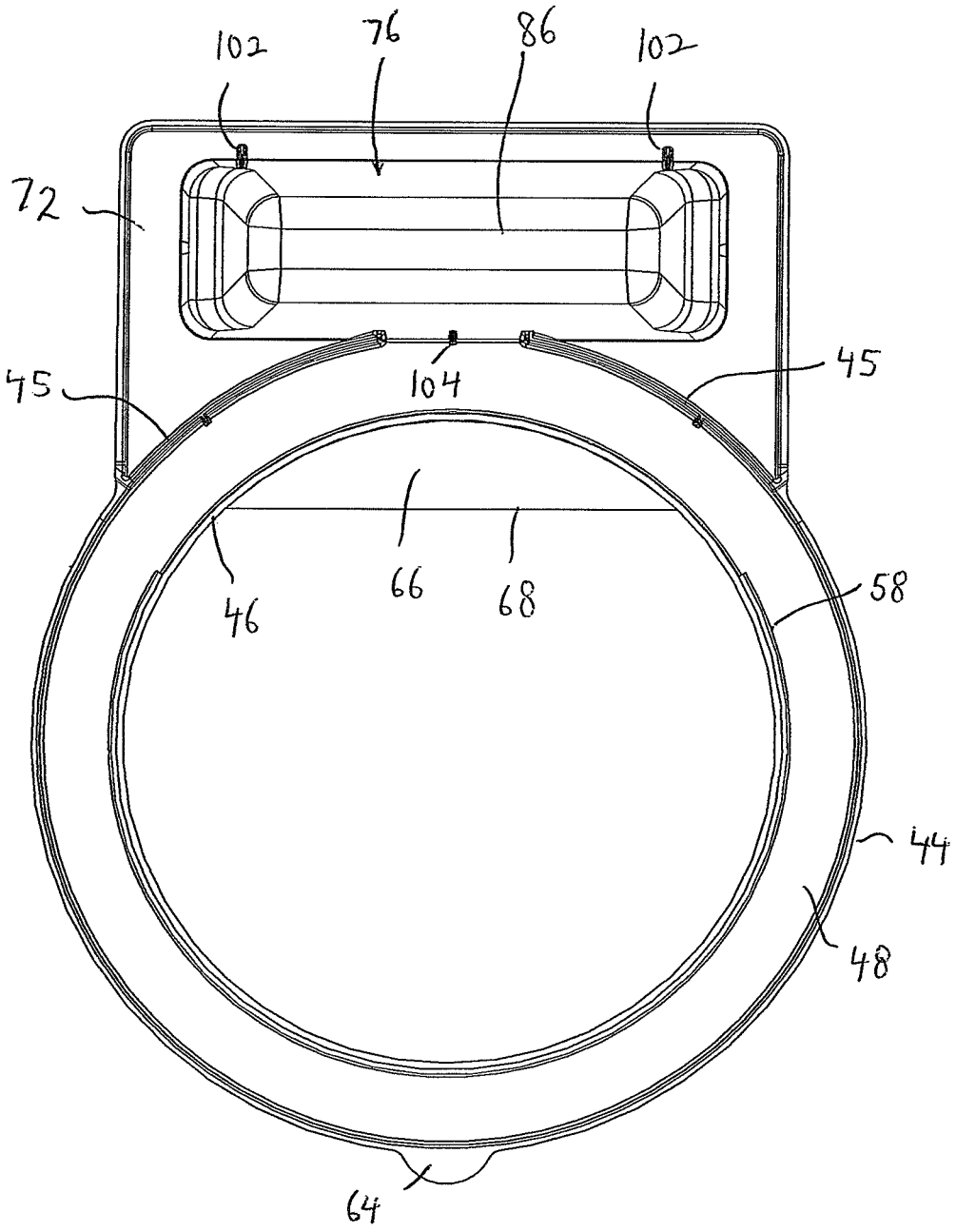
FIG. 5 is a bottom plan view of the cover guard.
Figure 6:
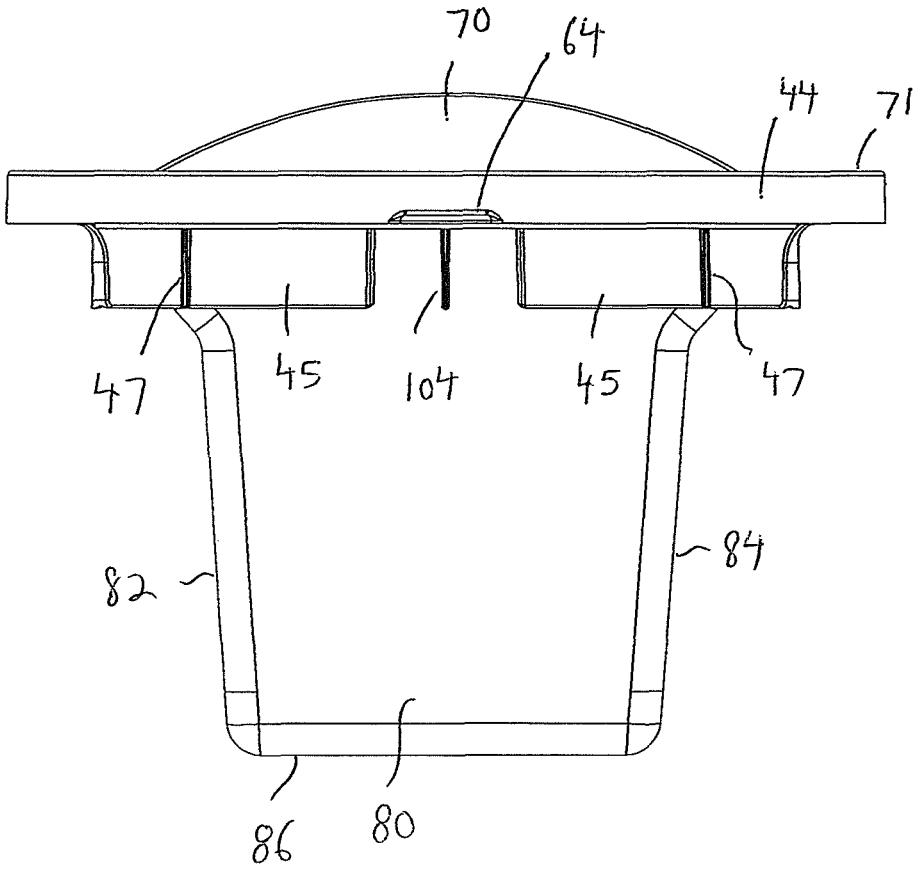
FIG. 6 is a front elevational view of the cover guard.
Figure 7:
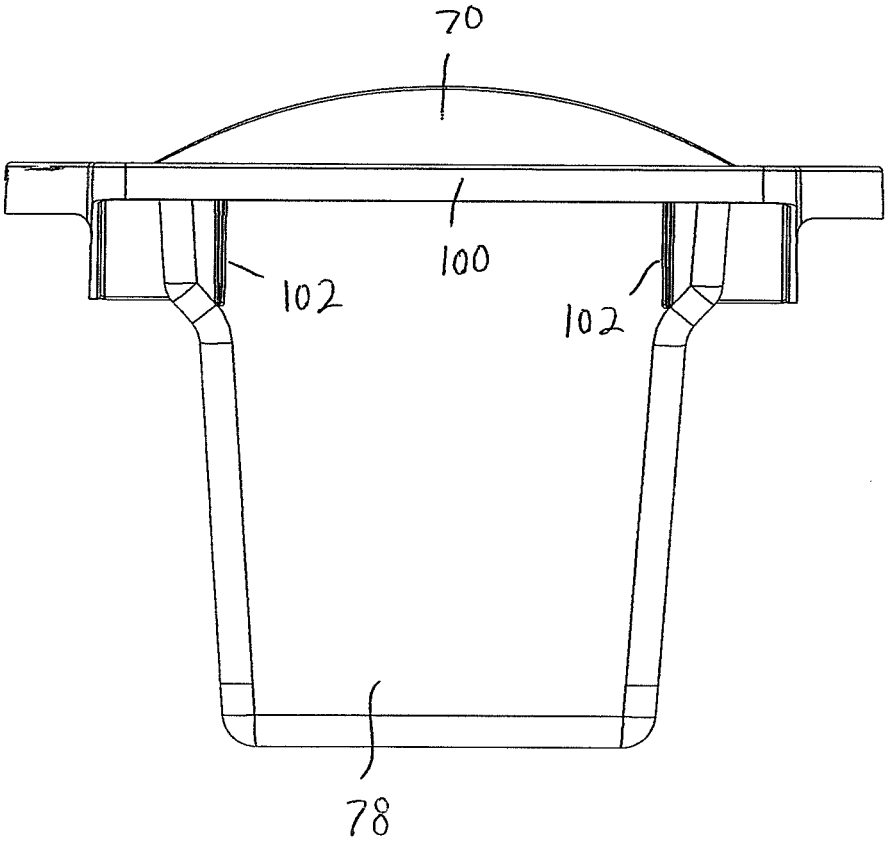
FIG. 7 is a rear elevational view of the cover guard.
Figure 8:
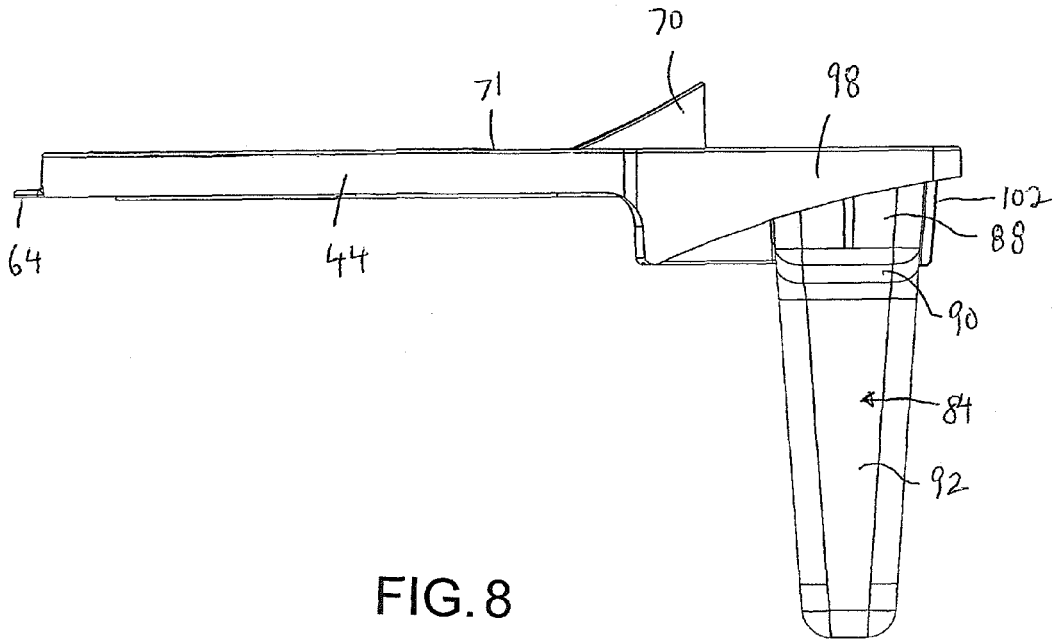
FIG. 8 is a right side elevational view of the cover guard.
Figure 9:
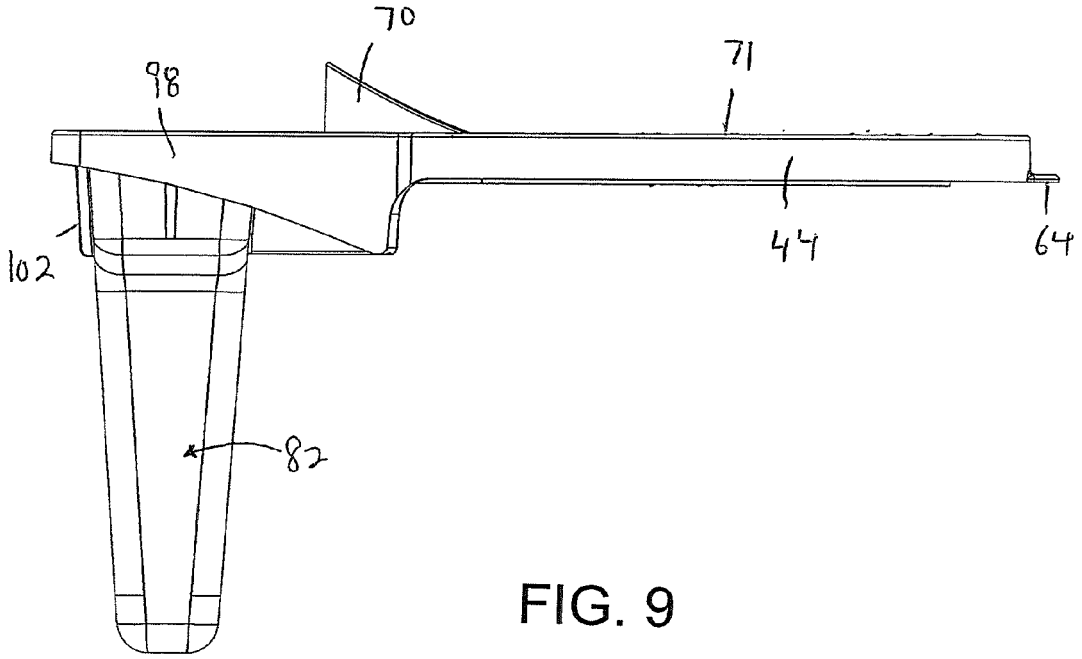
FIG. 9 is a left side elevational view of the cover guard.

A sector shaped brush wiper plate 66 extends inwardly of and is formed integrally as one piece with the inner facing surface of inner annular wall 46. Sector shaped brush wiper plate 66 includes a free, linear wiping edge 68 against which a paint brush can be wiped after being dipped into paint 11 in paint can 10, whereby any excess wiped paint falls back into paint can 10. As best shown in FIG. 3, sector shaped brush wiper plate 66 is angled downwardly toward free, linear wiping edge 68, so that any paint that falls onto sector shaped brush wiper plate 66, has a tendency to slide off sector shaped brush wiper plate 66 and fall back into paint can 10. It will be appreciated that free, linear wiping edge 68 is formed substantially coplanar with the lower edge of inner annular wall 46.

In addition, an arcuate drip guide wall 70 extends upwardly from the upper edge of upper annular wall 48 at the inner periphery thereof, immediately behind wiping plate 66, to prevent excess paint on the bristles of the paintbrush from spilling onto upper annular wall 48. Preferably, arcuate drip guide wall 70 extends arcuately around inner annular wall 46 for an arcuate angle of about 100 degrees, although the present invention is not limited thereto. It will be appreciated that drip guide wall 70, besides extending arcuately in the same arc as inner annular wall 46, also varies in height in an arcuate manner. This provides a barrier to the excess paint, while not impeding movement of the brush against wiping edge 68, which wiping action occurs rearwardly in a direction from wiping edge 68 toward arcuate drip guide wall 70.

In the event that any excess paint does spill onto upper annular wall 48, a spill bead 71 is formed at the outer periphery of upper annular wall 48. Thus, if any paint does escape onto upper annular wall 48, the excess paint will not run off the edge of upper annular wall 48 onto the side of paint can 10.

A generally rectangular upper wall extension 72 is formed as a unitary extension of upper annular wall 48 at the rear end thereof, and includes a central rectangular opening 74.

A wet paintbrush cup 76 extends down from the underside of upper wall extension 72 in surrounding relation to central rectangular opening 74, and forms a paintbrush well 77 for holding a wet paintbrush therein with the bristles face down. Wet brush cup 76 includes a downwardly extending rear wall 78, a downwardly extending front wall 80, downwardly extending side walls 82 and 84, and a bottom wall 86 that connects the lower edges of walls 78, 80, 82 and 84. Preferably, rear wall 78 and front wall 80 are inclined slightly toward each other in a downward direction. Each side wall 82 and 84 includes an upper wall section 88 that extends down from the underside of upper wall extension 72 in a slightly inwardly inclined manner, an inwardly inclined transition wall section 90 that extends down from the lower edge of upper wall section 88 in a greater inwardly inclined manner and forms a resting shoulder 91, and a lower wall section 92 that extends down from the lower edge of inwardly inclined transition wall section 90 in a slightly inwardly inclined manner. Thus, walls 78, 80, 82 and 84 taper down toward the lower end of wet paintbrush cup 76. Preferably, the corner connections 94 of walls 78, 80, 82, 84 and 86 to each other are slightly rounded, although the present invention is not limited thereto.

In addition, a skirt wall 96 extends down from the outer edge of rectangular upper wall extension 72 and is formed as an extension of outer annular wall 44. Skirt wall 96 includes side skirt wall sections 98 that extend from opposite rear ends of outer annular wall 44, with the lower edges thereof extending down below the lower edge of outer annular wall 44 at the connection to outer annular wall 44, and arcing upwardly toward the rear end thereof at a lesser height. A rear skirt wall section 100 connects the free ends of side skirt wall sections 98.

Figure 12:
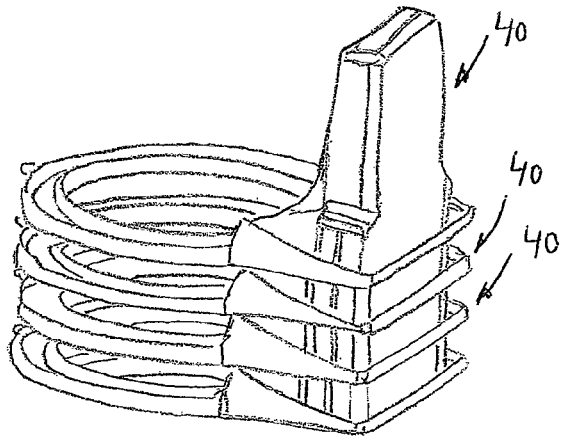
FIG. 12 is a perspective view showing stacking of a plurality of cover guards.

Stacking ribs 102 are provided on downwardly extending rear wall 78 and a stacking rib 104 is provided on downwardly extending front wall 80, which along with resting shoulders 91 of inwardly inclined transition wall section 90 and the lower edge of skirt wall section 45, provide stops for stacking of a plurality of cover guards 40 into each other in a nesting arrangement, as shown in FIG. 12.

Lastly, it is noted that spill bead 71 continues and also extends around the periphery of rectangular upper wall extension 72 to prevent excess paint from running off the edge of rectangular upper wall extension 72 onto the side of paint can 10.

It will be appreciated that cover guard 40 with attached wet paintbrush cup 76 is preferably formed as a unitary, single piece structure of a plastic material in a molding operation.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A cover guard for a rim of a paint can, comprising:

a cover for covering a rim of a paint can to prevent entry of paint into the rim, the cover being at least part annular to surround an opening, and having an inverted U-shaped cross-section for receiving the rim therein, wherein said cover includes an outer wall being at least part annular, an inwardly spaced wall being at least part annular and concentric with said outer wall, and an upper wall which connects together said outer wall and said inwardly spaced wall so as to form a channel between said upper wall, said inwardly spaced wall and said outer wall and which is at least part annular, for receiving the rim of the paint can therein, a brush wiper plate connected with said inwardly spaced wall of said cover and extending within said opening, said brush wiper plate having a free wiping edge extending within said opening against which a paintbrush can be wiped for removing excess paint from the paintbrush which has been dipped into paint in the paint can, such that any excess paint falls back into the paint can, said brush wiper plate connected with said inwardly spaced wall along a predetermined angular extent of said inwardly spaced wall, a drip guard wall extending upwardly from said cover only at an inner edge of said upper wall and only at an angular position thereon corresponding to said wiper plate, to prevent excess paint on bristles of the paintbrush from spilling onto the cover, said drip guard wall extending arcuately around said cover at least for said predetermined angular extent, and said drip guard wall varying in height in a circumferential direction around said cover so as to have a convex upper edge extending in the circumferential direction with a greatest height at a center of said drip guard wall which tapers down toward ends of said drip guard wall, and a wet paintbrush cup connected to the cover for holding a wet paintbrush therein, the wet paintbrush cup being positioned immediately behind said drip guard wall so that the drip guard wall prevents paint wiped from the paintbrush from entering the wet paintbrush cup.

2. A cover guard according to claim 1, wherein:

the cover covers an entire rim of the paint can to prevent entry of paint into the rim at any position of the rim, and said upper wall of said cover includes an upper surface having a bead extending upwardly from the upper surface thereof to prevent paint on the upper surface of the upper wall from escaping to a side of the paint can.

3. A cover guard according to claim 2, wherein a surface of at least one of the outer wall and the inwardly spaced wall which faces the channel, includes a recess which is at least part arcuate for receiving a bead at an upper edge of the rim of the paint can, so as to hold the cover guard onto the rim.

4. A cover guard according to claim 3, wherein said recess is formed at an upper end of said at least one of the outer wall and the inwardly spaced wall which faces the channel, immediately below the upper wall.

5. A cover guard according to claim 4, wherein said recess is formed in each of the outer wall and the inwardly spaced wall which faces the channel.

6. A cover guard according to claim 2, further comprising a finger tab extending radially outward from said outer wall and connected with said outer wall at a position substantially diametrically opposite of said wet paintbrush cup for aiding in removal of said cover from the rim of the paint can.

7. A cover guard according to claim 2, wherein the wet paintbrush cup tapers down in dimensions toward a lower end thereof.

8. A cover guard according to claim 2, wherein the wet paintbrush cup includes:

an upper wall having an opening, and a downwardly extending wall structure extending down from the upper wall in surrounding relation to the opening and which is closed by a bottom wall.

9. A cover guard according to claim 8, wherein said upper wall of said wet paintbrush cup is a continuation of the upper wall of the cover, and further comprising a bead extending upwardly from the upper wall of the wet paintbrush cup and formed as a continuation of the bead on the upper wall of the cover to prevent paint on the upper wall of the wet paintbrush cup from spilling over to a side of the paint can.

10. A cover guard according to claim 8, further including at least one stop for stacking a plurality of cover guards with each other in a nesting arrangement, wherein said at least one stop includes at least one projection which extends laterally outwardly from an outer surface of the downwardly extending wall structure.

11. A cover guard according to claim 1, wherein said brush wiper plate is sector shaped and the free wiping edge has a linear free edge against which the paintbrush can be wiped.

12. A cover guard according to claim 11, wherein said brush wiper plate is inclined downwardly toward the linear free edge.

* * * * *